United States Patent [19]

Doherty et al.

[11] Patent Number: 4,931,255

[45] Date of Patent: Jun. 5, 1990

[54] NICKEL-COBALT BASED ALLOYS

[75] Inventors: Roger D. Doherty, Wynnewood; Rishi P. Singh, Philadelphia; John S. Slaney, Greensburg, all of Pa.

[73] Assignee: SPS Technologies, Inc., Newtown, Pa.

[21] Appl. No.: 279,375

[22] Filed: Dec. 2, 1988

[51] Int. Cl.[5] ..... C22C 19/00

[52] U.S. Cl. ..... 420/586; 420/588; 420/585

[58] Field of Search ..... 420/586.1, 588; 148/442

[56] References Cited

U.S. PATENT DOCUMENTS

| | | | |
|---|---|---|---|
| 3,356,542 | 12/1967 | Smith | 148/32.5 |
| 3,767,385 | 10/1973 | Slaney | 148/442 |
| 3,837,847 | 9/1979 | Bieber | 148/442 |
| 4,795,504 | 1/1989 | Slaney | 148/410 |

*Primary Examiner*—Upendra Roy
*Assistant Examiner*—David W. Schumaker
*Attorney, Agent, or Firm*—James D. Dee; Aaron Nerenberg

[57] ABSTRACT

This invention relates to a nickel-cobalt alloy comprising the following elements in percent by weight:

| | |
|---|---|
| Carbon | about 0–0.05 |
| Molybdenum | about 6–11 |
| Iron | about 0–1 |
| Titanium | about 0–6 |
| Chromium | about 15–23 |

-continued

| | |
|---|---|
| Boron | about 0.005–0.020 |
| Columbium | about 1.1–10 |
| Aluminum | about 0.4–4.0 |
| Cobalt | about 30–60 |
| Nickel | balance |

the alloy having an electron vacancy number, $N_v$, defined by $N_v=0.61\ Ni+1.71\ Co+2.66\ Fe+4.66\ Cr+5.66\ Mo$ wherein the respective chemical symbols represent the effective atomic fractions of the respective elements present in the alloy, the value not exceeding the value $N_v=2.82-0.017\ W_{Fe}$, wherein $W_{Fe}$ is the percent by weight of iron in the alloy.

In one aspect, the alloy of the present invention is preferably finally cold worked at ambient temperature to a reduction in cross-section of at least 5% and up to about 40%, although higher levels of cold work may be used with some loss of thermomechanical properties. However, it may be cold worked at any temperature below the HCP-FCC transformation zone. After cold working, the alloys are preferably aged at a temperature between about 800° F. (427° C.) to about 1400° F. (760° C.) for about 4 hours. Following aging, the alloys may be air-cooled.

In another aspect, the alloy of the present invention is aged at a temperature of from about 1200° F. (650° C.) to about 1652° F. (900° C.) for about 1–200 hours and then cold worked at ambient temperature to achieve a reduction in cross-section of at least 5% and up to about 40%. After cold working, the alloys are preferably aged at a temperature of from about 800° F. (427° C.) to about 1400° F. (760° C.) for about 4 hours. Following aging, the alloys may be air-cooled.

19 Claims, No Drawings

NICKEL-COBALT BASED ALLOYS

BACKGROUND OF THE INVENTION

1. Field of the Invention

This invention relates to nickel-cobalt base alloys and, more particularly, nickel-cobalt base alloys having excellent corrosion resistance combined with high strength and ductility at higher service temperatures.

2. Description of the Prior Art

U.S. Pat. No. 3,356,542, Smith, issued Dec. 5, 1967 (the "Smith" patent), discloses cobalt-nickel base alloys containing chromium and molybdenum. These alloys are claimed to be corrosion resistant and capable of being work-strengthened under certain temperature conditions to have very high ultimate tensile and yield strengths. These patented alloys can exist in one of two crystalline phases, depending on temperature. They are also characterized by a composition-dependent transition zone of temperatures in which transformations between phases occur. At temperatures above the upper temperature limit of the transformation zone, the alloys are stable in the face-centered cubic ("FCC") structure. At temperatures below the lower temperature of the transformation zone, the alloys are stable in the hexagonal close-packed ("HCP") form. By cold working metastable face-centered cubic material at a temperature below the lower limit of the transformation zone, some of it is transformed into the hexagonal close-packed phase which is dispersed as platelets throughout a matrix of the face-centered cubic material. It is this cold working and phase-transformation which is indicated to be responsible for the ultimate tensile and yield strengths of the patented alloys. However, the alloys of the Smith patent have stress rupture properties which make them unsuitable for temperatures above about 800° F. (427° C.).

U.S. Pat. No. 3,767,385, Slaney, issued Oct. 23, 1973 (the "Slaney" patent), discloses a cobalt-nickel alloy which is an improvement on the Smith patent and which has stress rupture properties suitable for service temperatures to about 1100° F. (539° C.). In this patent, the composition of the alloy was modified by the addition of aluminum, titanium and columbium in order to take advantage of additional precipitation hardening of the alloy, supplementing the hardening effect due to conversion of FCC to HCP phase. The alloys disclosed include elements, such as iron, in amounts which were formerly thought to result in the formation of disadvantageous topologically close-packed phases such as the sigma, mu or chi phases (depending on composition), and thus thought to severely embrittle the alloys. But this disadvantageous result is said to be avoided with the invention of the Slaney patent. For example, the alloys of the Slaney patent are reported to contain iron in amounts from 6% to 25% while being substantially free of embrittling phases.

According to the Slaney patent, it is not enough to constitute the patented alloys within the specified ranges of cobalt, nickel, iron, molybdenum, chromium, titanium, aluminum, columbium, carbon, and boron. Rather, the alloys must further have an electron vacancy number ($N_v$), which does not exceed certain fixed values in order to avoid the formation of embrittling phases. The $N_v$ number is the average number of electron vacancies per 100 atoms of the alloy. By using such alloys, the Slaney patent states that cobalt-based alloys which are highly corrosion resistant and have excellent ultimate tensile and yield strengths can be obtained. These properties are disclosed to be imparted by formation of a platelet HCP phase in a matrix FCC phase and by precipitating compound of the formula $Ni_3X$, where X is titanium, aluminum and/or columbium. This is accomplished by working the alloys at a temperature below the lower temperature of a transition zone of temperatures in which transformation between HCP phase and FCC phase occurs and then heat treating between 800° F. (427° C.) and 1350° F. (732° C.) for about 4 hours.

However, none of these prior art references disclose the unique alloy of the present invention which retains excellent tensile and ductility levels and stress rupture properties at temperatures up to about 1350° F. (732° C.). This improvement in higher temperature properties is believed to be due to the precipitation of a stable ordered phase in addition to the higher temperature stability of the HCP phase and minimization of the topologically by close-packed (TCP) phases. Presence of these phases has deleterious effects on the mechanical properties which are well-known to those skilled in the art. The alloys of the prior art, i.e. the Slaney patent, retain their strength only up to 1100° F. (593° C.) and above this temperature show poor stress rupture properties.

SUMMARY OF THE INVENTION

This invention relates to a nickel-cobalt alloy comprising the following elements in percent by weight:

| | |
|---|---|
| Carbon | about 0–0.05 |
| Molybdenum | about 6–11 |
| Iron | about 0–1 |
| Titanium | about 0–6 |
| Chromium | about 15–23 |
| Boron | about 0.005–0.020 |
| Columbium | about 1.1–10 |
| Aluminum | about 0.4–4.0 |
| Cobalt | about 30–60 |
| Nickel | balance |

the alloy having an electron vacancy number, $N_v$, defined by $N_v=0.61Ni+1.71Co+2.66Fe+4.66Cr+5.66Mo$ wherein the respective chemical symbols represent the effective atomic fractions of the respective elements present in the alloy, the value not exceeding the value $N_v=2.82-0.017\ W_{Fe}$, wherein $W_{Fe}$ is the percent by weight of iron in the alloy. The values of the atomic fractions are those of the residual matrix after the $Ni_3X$ phase has been precipitated. The method of calculation is set forth below in the description of the preferred embodiments.

The preferred composition for the alloy of this invention is as follows, in weight percent:

| | |
|---|---|
| Carbon | about 0.01 max |
| Molybdenum | about 7.5 |
| Titanium | about 1.4 |
| Chromium | about 19.5 |
| Boron | about 0.01 |
| Columbium | about 2.8 |
| Aluminum | about 0.8 |
| Cobalt | about 42.5 |
| Nickel | balance |

In one aspect, the alloy of the present invention is preferably finally cold worked at ambient temperature to a reduction in cross-section of at least 5% and up to about 40%, although higher levels of cold work may be used with some loss of thermomechanical properties. However, it may be cold worked at any temperature below the HCP-FCC transformation zone. After cold working, the alloys are preferably aged at a temperature between about 800° F. (427° C.) to about 1400° F. (760° C.) for about 4 hours. Following aging, the alloys may be air-cooled.

In another aspect, the alloy of the present invention is aged at a temperature of from about 1200° F. (650° C.) to about 1652° F. (900° C.) for about 1–200 hours and then cold worked at ambient temperature to achieve a reduction in cross-section of at least 5% and up to about 40%. After cold working, the alloys are preferably aged at a temperature of from about 800° F. (427° C.) to about 1400° F. (760° C.) for about 4 hours. Following aging, the alloys may be air-cooled.

The present invention provides an alloy which has excellent tensile and ductility levels and stress rupture properties at temperatures up to about 1350° F. (732° C.). This improvement in higher temperature properties is believed to be due to the precipitation of a stable ordered phase in addition to the higher temperature stability of the HCP phase and minimization of the TCP phases. The presence of these phases have deleterious effects on the mechanical properties of the alloy.

Accordingly, it is an object of the present invention to provide alloy materials having advantageous mechanical properties and hardness levels both at room temperature and elevated temperature. It is a further object of the present invention to provide alloys having excellent tensile and ductility levels, as well as stress rupture properties at temperatures up to about 1350° F. (732° C.). These and other objects and advantages of the present invention will be apparent to those skilled in the art upon reference to the following detailed description of the preferred embodiments.

DESCRIPTION OF THE PREFERRED EMBODIMENTS

The alloy of the present invention comprises about 0–0.05% by weight carbon, about 6–11% by weight molybdenum, about 0–1% by weight iron, about 0–6% by weight titanium, about 15–23% by weight chromium, about 0.005–0.020% by weight boron, about 1.1–10% by weight columbium, about 0.4–4.0% by weight aluminum, about 30–60% by weight cobalt, and the balance nickel. However, about 0–3% by weight slicon may also be utilized. Also, the preferred range for cobalt is 40–60% by weight.

Preferably, the alloy of the present invention has the composition about 0–0.01% by weight carbon, about 7.5% by weight molybdenum, about 1.4% by weight titanium, about 19.5% by weight chromium, about 0.01% by weight boron, about 2.8% by weight columbium, about 0.8% by weight aluminum, about 42.5% by weight cobalt and the balance nickel, with no iron present in the alloy.

However, not all of those alloys whose composition fall within the ranges given above are encompassed by the present invention, since some of these composition may include alloys containing embrittling phases. Accordingly, the alloys of the present invention must also have an electron vacancy number, $N_v$, defined by $$N_v = 0.61Ni + 1.71Co + 2.66Fe + 4.66Cr + 5.66Mo$$

wherein the respective chemical symbols represent the effective atomic fractions of the respective elements present in the alloy, with the value not exceeding the value $N_v = 2.82 - 0.017W_{Fe}$, wherein $W_{Fe}$ is the percent by weight of iron in the alloy.

The present invention provides an alloy which retains excellent tensile and ductility levels and stress rupture properties at temperatures up to about 1350° F. (732° C.). This improvement in higher temperature properties is believed to be due to the precipitation of a stable ordered phase in addition to the higher temperature stability of the HCP phase and minimization of the topological close-packed (TCP) phases. Presence of these phases have deleterious effects on the mechanical properties, which are well-known to those skilled in the art. The alloys of the prior art, i.e. the Slaney patent alloys, retain their strength up to only 1100° F. (593° C.) and above this temperature show poor stress rupture properties.

The main factors which restrict the higher temperature strength of these prior art alloys are the lower HCP to FCC transus temperature and instability of the strengthening phase (gamma-prime) at higher temperature. The HCP to FCC transus temperature in these prior art alloys and the thermal stability of the cubic ordered gamma-prime phase can be improved by alloy additions. The elements which form the gamma-prime phase are nickel, titanium, aluminum and columbium. Furthermore, the cubic gamma-prime phase is sometimes a metastable phase and transforms into a non-cubic more stable phase after prolonged exposure at elevated temperatures and this change lowers the ductility drastically. Accordingly, it is very critical that this transformation is suppressed by suitable alloying. In the present invention, this is achieved by lowering the titanium content and increasing the aluminum content of the alloy.

It is necessary, in addition to selecting an alloy composition within the specified ranges, to select a composition having an acceptable electron vacancy number as set forth above. In this connection, the "effective atomic fraction" of elements set forth in the formula used to calculate the electron vacancy number takes into account the postulated conversion of a portion of the metal atoms present, particularly nickel, into compounds of the type $Ni_3X$ (such as gamma prime phase materials). For purposes of defining compositions suitable for practicing the present invention, the term "effective atomic fraction" is given the meaning set forth in this and the following explanatory paragraphs. It is assumed in defining (and calculating) the effective atomic fraction that all of the materials referred to previously as those capable of forming gamma prime phase with nickel actually do combine with nickel to form $Ni_3X$, where X is titanium, aluminum and/or columbium.

For the alloys of the present invention, the total atomic percent of each of the elements present in a given alloy is first calculated from the weight percent ignoring any carbon and/or boron in the composition. Each atomic percentage represents the number of atoms of an element present in 100 atoms of alloy. The number of atoms/100 (or atomic percentage) of elements forming gamma prime phase with nickel, but not including nickel, is totalled and multiplied by 4 to give an approximate number of atoms/100 involved in $Ni_3X$ formation. This figure, however, must be adjusted.

R. W. Guard et al, in "The Alloying Behavior of $Ni_3Al$ (gamma-prime phase)," Met. Soc. AIME 215, 807 (1959), have shown that cobalt, iron, chromium, and molybdenum enter such an $Ni_3X$ compound in amounts up to 23, 15, 16, and 1 percent, respectively. To approximate the number of atoms/100 of each of these metals which are also "tied up" in the $Ni_3X$ phase and are unavailable for formation of non-$Ni_3X$ matrix alloy, the product of the maximum percent solubility of each metal in $Ni_3X$, its atomic fraction in the alloy under consideration, and the total number of atoms of $Ni_3X$ possible in 100 atoms of alloy is found.

The number of atoms of Ni, Co, Fe, Cr, and Mo in 100 atoms of alloy, respectively, are then corrected by subtraction of the figures representing the amount of each of these metals in the $Ni_3X$ phase. The difference approximates the number of atoms per 100 of the nominal alloy composition which are effectively available for matrix alloy formation. Since this total number is less than 100, the "effective atomic percent" of each of the elements-based on this total-is now calculated. The effective atomic fraction, which is the quotient of the effective atomic percent divided by 100, is employed in the determination of $N_v$ for these alloys. This calculation is exemplified in detail in U.S. Pat. No. 3,767,385, Slaney, the disclosure of which is incorporated by reference herein. As can be appreciated, the maximum allowable electron vacancy number is an approximation intended to serve as a tool for guiding the invention's practitioner. Some compositions for which the electron vacancy number is higher than the calculated "maximum" may also be useful in practicing the invention. These can be determined empirically, once the workers skilled in the art is in possession of the present subject matter.

The alloy composition of this invention is suitably prepared and melted by any appropriate technique known in the art, such as conventional ingot-formation techniques or by powder metallurgy techniques. Thus, the alloys can be first melted, suitably by vacuum induction melting, at an appropriate temperature, and then cast as an ingot. After casting as ingots, the alloy is preferably homogenized and then hot rolled into plates or other forms suitable for subsequent working. Alternatively, the molten alloy can be impinged by gas jet or on a surface to disperse the melt as small droplets to form powders. Powdered alloys of this sort can, for example, be hot or cold pressed into a desired shape and then sintered according to techniques known in powder metallurgy. Coining is another powder metallurgy technique which is available, along with hot isostatic pressing and "plasma spraying" (the powdered alloy is sprayed hot onto a substrate from which it is later removed, and then cold worked in situ by suitable means such as swaging, rolling or hammering).

In one preferred embodiment of this invention, the alloy is finally cold worked at a temperature below the lower temperature limit of the HCP-FCC phase transformation zone to achieve a reduction in cross-section of at least 5% to about 40%, although higher levels of cold work may be used with some loss of thermomechanical properties. Preferably, the alloy is finally cold worked at ambient temperature. After cold working, the alloys are preferably aged at a temperature of from about 800° F. (427° C.) to about 1400° F. (760° C.) for about 4 hours. Following aging, the alloys may be air-cooled.

In another preferred embodiment of this invention, the gamma-prime phase is generally formed in the alloy by aging the alloy at a temperature of from about 1200° F. (650° C.) to about 1652° F. (900° C.) for about 1 to about 200 hours and then cold working the alloy at ambient temperature to achieve a reduction in cross-section of at least 5% to about 40%. After cold working the alloys, they are then preferably aged at a temperature of from about 800° F. (427° C.) to about 1400° F. (760° C.) for about 4 hours. Following aging, the alloys may be air-cooled.

This invention provides unique thermomechanical properties at temperatures in the neighborhood of 1350° F. (732° C.) where presently available alloys are no longer serviceable. This provides service temperatures for jet engine fasteners and other parts for higher temperature service, thus making it possible to construct such engines and other equipment for higher operating temperatures and greater efficiency than heretofore possible.

While this invention has been described with respect to particular embodiments thereof, it is apparent that numerous other forms and modifications of this invention will be obvious to those skilled in the art. The appended claims in this invention generally should be construed to cover all such obvious forms and modifications which are within the true spirit and scope of the present invention.

What is claimed is:

1. A nickel-cobalt alloy comprising the following elements in percent by weight:

| | |
|---|---|
| Carbon | about 0–0.05 |
| Molybdenum | about 6–11 |
| Iron | about 0–1 |
| Titanium | about 0–6 |
| Chromium | about 15–23 |
| Boron | about 0.005–0.020 |
| Columbium | about 1.1–10 |
| Aluminum | about 1.1–4.0 |
| Cobalt | about 30–60 |
| Nickel | balance |

said alloy having an electron vacancy number, $N_v$, defined by $N_v=0.61Ni+1.71Co+2.66Fe+4.66Cr+5.66Mo$ wherein the respective chemical symbols represent the effective atomic fractions of the respective elements present in the alloy, said value not exceeding the value $N_v=2.82-0.017W_{Fe}$, wherein $W_{Fe}$ is the percent by weight of iron in the alloy.

2. The alloy according to claim 1 further comprising 0–3 percent by weight silicon.

3. The alloy according to claim 1 wherein said alloy has been cold worked at a temperature below the lower temperature limit of the HCP-FCC phase transformation zone to achieve a reduction in cross-section of from 5% to about 40%.

4. The alloy according to claim 3 wherein said alloy has been aged at a temperature of from about 800° F. to about 1400° F. for about 4 hours after cold working.

5. The alloy according to claim 4 wherein the alloy has been cold worked at ambient temperature.

6. The alloy according to claim 4 wherein said alloy has been air-cooled after aging.

7. The alloy according to claim 1 wherein said alloy has been aged at a temperature of from about 1200° F. to about 1652° F. for about 1–200 hours and then cold worked to achieve a reduction in cross-section of at least 5% to about 40%.

8. The alloy according to claim 7 wherein the cold worked alloy has been aged at a temperature of from about 800° F. to about 1400° F. for about 4 hours.

9. The alloy according to claim 8 wherein the cold worked alloy has been air-cooled after aging.

10. A nickel-cobalt alloy comprising the following elements in percent by weight:

| | |
|---|---|
| Carbon | 0–0.05 |
| Molybdenum | 6–11 |
| Iron | 0–1 |
| Titanium | 0–6 |
| Chromium | 15–23 |
| Boron | 0.005–0.020 |
| Columbium | 1.1–10 |
| Aluminum | 1.1–4.0 |
| Cobalt | 30–60 |
| Nickel | balance |

said alloy having an electron vacancy number, $N_v$, defined by $N_v=0.61Ni+1.71Co+2.66Fe+4.66Cr+5.6\text{-}6Mo$ wherein the respective chemical symbols represent the effective atomic fractions of the respective elements present in the alloy, said value not exceeding the value $N_v=2.82-0.017W_{Fe}$, wherein $W_{Fe}$ is the percent by weight of iron in the alloy, said alloy having been cold worked at a temperature below the lower temperature limit of the HCP-FCC phase transformation zone to achieve a reduction in cross-section of from 5% to 40% and then aged after cold working at a temperature of from 800° F. to 1400° F. for about 4 hours.

11. The alloy according to claim 10 further comprising 0–3 percent by weight silicon.

12. The alloy according to claim 10 wherein the alloy has been cold worked at ambient temperature.

13. The alloy according to claim 10 wherein the said alloy has been air-cooled after aging.

14. A nickel-cobalt alloy comprising the following elements in percent by weight:

| | |
|---|---|
| Carbon | 0–0.05 |
| Molybdenum | 6–11 |
| Iron | 0–1 |
| Titanium | 0–6 |
| Chromium | 15–23 |
| Boron | 0.005–0.020 |
| Columbium | 1.1–10 |

-continued

| | |
|---|---|
| Aluminum | 1.1–4.0 |
| Cobalt | 30–60 |
| Nickel | balance |

said alloy having an electron vacancy number, $N_v$, defined by $N=0.61Ni+1.71Co+2.66Fe+4.66Cr+5.6\text{-}6Mo$ wherein the respective chemical symbols represent the effective atomic fractions of the respective elements present in the alloy, said value not exceeding the value $N_v=2.82-0.017W_{Fe}$, wherein $W_{Fe}$ is the percent by weight of iron in the alloy, said alloy having been aged at a temperature of from 1200° F. to 1652° F. for 1 to 200 hours and then cold worked to achieve a reduction in cross-section of from 5% to 40%.

15. The alloy according to claim 14 further comprising 0–3 percent by weight silicon.

16. The alloy according to claim 14 wherein the cold worked alloy has been aged at a temperature of from about 800° F. to about 1400° F. for about 4 hours.

17. The alloy according to claim 14 wherein the cold worked alloy has been air-cooled after aging.

18. The alloy according to claim 1, 10 or 14 in the form of a fastener.

19. A nickel-cobalt alloy comprising the following elements in percent by weight:

| | |
|---|---|
| Carbon | about 0–0.01 |
| Molybdenum | about 7.5 |
| Titanium | about 1.4 |
| Chromium | about 19.5 |
| Boron | about 0.01 |
| Columbium | about 2.8 |
| Aluminum | about 0.8 |
| Cobalt | about 42.5 |
| Nickel | balance |

said alloy having an electron vacancy number, $N_v$, defined by $N_v=0.61\ Ni+1.71Co+2.66Fe+4.66Cr+5.6\text{-}6Mo$ wherein the respective chemical symbols represent the effective the atomic fractions of the respective elements present in the alloy, said value not exceeding the value $N_v=2.82-0.017W_{Fe}$, wherein $W_{Fe}$ is the percent by weight of iron in the alloy.

* * * * *